US005337541A

United States Patent [19]

Gmuer

[11] Patent Number: 5,337,541

[45] Date of Patent: Aug. 16, 1994

[54] METHOD FOR THE AUTOMATIC SUPPLY OF BAGS AND BAG HANGING APPARATUS

[75] Inventor: Bruno Gmuer, St. Gallen, Switzerland

[73] Assignee: Buehler AG, Uzwil, Switzerland

[21] Appl. No.: 927,514

[22] PCT Filed: Jan. 13, 1992

[86] PCT. No.: PCT/CH92/00005

§ 371 Date: Sept. 15, 1992

§ 102(e) Date: Sept. 15, 1992

[87] PCT Pub. No.: WO92/12900

PCT Pub. Date: Aug. 6, 1992

[30] Foreign Application Priority Data

Jan. 26, 1991 [CH] Switzerland ..... 00231/91

[51] Int. Cl.[5] ..... B65B 43/30

[52] U.S. Cl. ..... 53/459; 53/386.1; 53/573

[58] Field of Search ..... 53/459, 468, 571, 573, 53/570, 572, 386.1

[56] References Cited

U.S. PATENT DOCUMENTS

| | | | |
|---|---|---|---|
| 4,305,241 | 12/1981 | Tetenborg et al. | 53/573 X |
| 4,320,615 | 3/1982 | Gmur | 53/573 X |
| 4,577,454 | 3/1986 | Wright et al. | 53/573 X |
| 4,664,162 | 5/1987 | Durant | 53/573 X |
| 4,779,403 | 10/1988 | Perrucchini | 53/573 |
| 4,970,847 | 11/1990 | Gradwohl | 53/573 |

FOREIGN PATENT DOCUMENTS

3024284A1 6/1980 Fed. Rep. of Germany .

*Primary Examiner*—James F. Coan

*Attorney, Agent, or Firm*—McAulay Fisher Nissen Goldberg & Kiel

[57] ABSTRACT

A method and apparatus for automatic bag hanging allows far more than 1000 bag hangings per hour. A bag is removed from a bag bucket conveyor by its closed end and is guided, bottom forward, at an approximately right angle around a roller deflection device. The bag is grasped, first in an upright position and so as to be slightly opened already by bag opening claw pairs 23, opened, and simultaneously guided via a double-lever system to a bag filling sleeve and automatically clamped.

20 Claims, 9 Drawing Sheets

METHOD FOR THE AUTOMATIC SUPPLY OF BAGS AND BAG HANGING APPARATUS

BACKGROUND OF THE INVENTION a) Technical Field

The invention is directed to a method for the automatic supply of bags for packing bulk material by means of positive guidance of the bags from a bag stack, opening the bag filling opening, and hanging the open end of the bag at a filling sleeve.

b) Background Art

U.S. Pat. No. 3,566,578 shows an automatic hanging of shipping bags such as was suggested at the inception of automation. The basic idea is simple. A whole stack of paper bags is put on a conveyor belt in the correct position as close as possible to the filling sleeve and each individual paper bag is attached via an automatic gripper with suction cups to the bag filling sleeve which is provided with a bag opening and holding device which likewise works automatically. Such a device is easily capable of hanging several hundred bags per hour at the filling sleeve, an operation which over a longer period of time would degrade a person to a robot and which could be withstood by this person over the course of an entire day only with the greatest effort. When such automatic devices were introduced, it was already known that a natural product such as paper can have different, often even unpleasant, behavior.

The most common disturbing factor is moisture in the air and in the material. Often a bag cannot be opened at all with the given mechanical means, or two bags are lifted by the automatic grippers simultaneously.

Over the course of time this state of affairs was tolerated since it was necessary in any case, due to completely different problems, e.g. the bursting of full bags, for a supervisor to monitor the entire packing operation and to ensure order as well as provide for a smooth feed of bags. A noticeable increase in hourly output was not possible since a more rapid sequence of movements simultaneously increased the frequency of disturbances so that ultimately an increase in output calculated over the course of a day did not occur.

Opening the bag in a problem-free manner remained a principle weak point. In U.S. Pat. No. 4,320,615, the present applicant attempted to overcome both disadvantages of the older solutions. As was shown in FIGS. *2a*, *2b* and *2c* of this patent, it was possible, by means of a simultaneous rolling process, to prepare the opening of a bag while lifting the bag and to almost completely prevent a second or third bag from being carried along. In this way approximately 600 to 800 bags per hour could be hung and disturbances were sharply reduced.

For a long time, the prevailing opinion in technical circles was that it was substantially more economical to ship larger quantities of mill products to the consumer in a loose state by tank vehicles. A sharp reduction in variety was simultaneously anticipated. But recent trends have now shown that a large variety is demanded.

Further, great advances in automation in the area of palletization of bags have been achieved so that transporting by bags has gained ground again and an increase in the hourly output is demanded in particular.

OBJECT AND SUMMARY OF THE INVENTION

The invention has the object of developing a novel hanging of shipping bags which allows bags to be hung in a problem-free manner in quantities of 1000 to 1200 per hour or more.

The solution according to the invention is a method comprising the steps of multiply stacking and removing the bags individually from a removal location, swiveling the bags, opening the bags and hanging them.

Bag stacks which are mechanically displaceable in multiple ways are preferably formed, and the bags are inserted on a displacement path by hand and individual bags are removed by automatic means in a separate location.

Another advantageous construction idea consists in that the bag is opened in at least two steps by additional automatic means.

In a particularly preferred manner, the bag is guided into an upright position from the bag stack via a deflecting feed unit and opened slightly in the region of the deflecting feed unit when the upright position is achieved.

The present inventor has recognized that common logic, which has it that every additional movement in a work sequence "costs time", has proven false at least with respect to an automatic bag hanging device.

On the contrary, in the case of natural products with sharply varying characteristics unequivocal effects which are still capable of functioning even in the worst case must be used. Surprisingly, by specifically taking into account the physical characteristics of a paper bag of the still considerable size of around 0.5 $m^2$ paper surface area by means of specifically tailored movements with corresponding auxiliary guiding means, particularly roller deflection means and a swiveling and opening device, a movement speed which was not previously believed to be possible for such large paper bags, or corresponding acceleration, respectively, are permitted and a more precise, controlled paper guidance is nevertheless achieved without fluttering or flapping movements and the like.

In particular, the additional movement of the novel inventive idea of "drawing over the knee" has proven surprisingly effective, since bags which have been stored under poor conditions over a long period of time are loosened almost to "the last fiber" and the "unwillingness to open" is accordingly overcome. In this way, by means of the roller deflection, the opening of the bag is also prepared particularly by means of the cooperation of deflection and suction means and, as will be shown in the following, is already begun at the same time. The strong base of the bag which is grasped by the grippers is compulsorily deflected with the bottom in front and pushed down. Tests have confirmed that two points of concern, i.e. the complete opening even of all folds down to the bottom of the bag for the filling process and particularly the opening of the open end of the bag, can be carried out in this way with a previously unattainable operating reliability. The course of movement is achieved with somewhat more costly means compared to the two known constructions mentioned above; but observing the course of an individual bag will show that a completely natural course of movement is executed without the use of destructive force, but still in a compulsory manner, so that the proposed object is successfully met.

Surprisingly harmonious movements were achieved for the bag material in that the bag is opened by means of two gripping claw pairs acting in opposite directions. The gripping claw pairs take over the bag, preferably after it has already been slightly opened, without colliding. A very high hourly output of up to 1200 bags and a completely trouble-free operation was enabled in that the bags are stacked, mechanically fed, grasped individually by gripping means at the closed base of the bag, brought into an upright position via a deflecting feed unit along an approximately right or slightly obtuse angle and arranged at the bag filling sleeve by means of a swivelable bag opening device.

The invention is further directed to an automatic bag hanging apparatus for bulk materials with removal of individual bags from a bag stack by gripping means, opening of the bag filling opening, and hanging of the open end of the bag at a bag filling sleeve, and is characterized in that a bag lying flat with its closed bottom in front can be brought into an upright position around roller deflection means and placed at the bag filling sleeve by means of a swiveling and opening device.

One or more deflecting belts are preferably arranged in the region of the roller deflection means. In so doing, it is possible e.g. to drive the roller deflection means by means of a motor and/or to drive the deflection belts or both. In particularly difficult cases a minimum differential speed of a small percentage can be provided between the roller deflection means and the deflecting belt or deflecting belts, respectively, so that the two plies of a bag can simultaneously be somewhat displaced relative to one another. In a particularly advantageous manner the distance and/or contact pressure between the roller deflection means and deflecting belt is variable and the deflecting belt is preferably adaptable along a portion of the roller deflection means so as to conform in shape. A simple solution with respect to construction can be achieved in that each deflection belt has pairs of deflection rollers and each deflection roller of a deflection pair can be moved toward and away from the roller deflection means with the belt for a looping movement with respect to the roller deflection means.

Good results are achieved when the individual bag which is lifted from the bag stack is transferred with its closed end in front from the horizontal line into an approximately diagonally inclined position by the roller deflection means. The deflection means are preferably constructed as a rotationally movable hollow cylinder, can be connected to a vacuum pump, and a partial area of the cylinder wall has suction openings for gripping the bag and preparing the opening. The roller movement is controlled in such a way that an end portion of the inner bag plies in the region of the bag opening temporarily remains clinging to the partial area of the cylinder wall with the suction openings after the conclusion of the deflecting movement, while the outer bag ply or outer bag plies has/have already been opened slightly in the region of the deflecting feed. In this way the bag, which has been flexed as it were via the roller deflection means, is held in an exactly controllable end position by the suction force of the vacuum during the retreating movement of the deflection belt or belts in such a way that the bag on the whole remains in position and the outer paper ply which faces away is already slightly lifted at the same time. Daily experience with small household paper bags has also shown that the biggest problems often occur with the initial opening of the bag. But these problems are solved for the much bigger shipping bags, as suggested, as part of the course of movement.

In another particularly advantageous construction of the inventive idea for the automatic hanging of shipping bags at a bag filling sleeve it is suggested that it prepare the bags individually and have two gripping claw pairs which are attached to a swivel arm so as to be compulsorily driven in opposite directions for transferring a bag in the opened state from the bag preparation to the bag filling sleeve. The gripping claw pairs preferably execute an opening and closing movement via a lever articulation and pneumatic drive means analogous to the thumb and index finger of the left and right human hand, and the swivel arm carries out a circular movement directed from the bottom to the top for hanging a bag via a double-lever system. It is important that the gripping claws and the bag hanging device be controllable independently and have means for coordinating the two sequences of movement.

The bag hanging apparatus is further constructed in such a way that the bag opening claws can be brought into a totally spread apart return or initial position, in an incompletely closed bag takeover position, and in a controllable maximum bag opening position via a lever articulation which is movable in a compulsory manner by hydraulic or pneumatic means. Further, the bag opening claws can preferably be brought from the bag opening position into a controllable bag filling sleeve shape position. The bag opening claws have suction cups.

The novel invention is further directed to a bag stack conveyor device and is characterized in that it has a plurality of individual bucket-shaped bag magazines which are movable from an insertion position into a removal position via controllable conveying means.

In the previously known solutions, a conveyor belt-type transporting belt was normally used for this purpose which was conceived for horizontal or inclined bag stacking. However, it has been shown that merely laying down a bundle of paper bags must be performed very exactly to avoid disturbances in subsequent mechanical manipulations due precisely to alternating positions. To the present day, the placement of the bags requires very great care and much time. On the other hand the novel invention proposes the construction of a plurality of bucket-shaped bag magazines so that even optional sizes can be inserted in the latter simply and quickly. A plurality of bag magazines can be filled with empty bags one after the other when the conveying means are constructed as a circumferentially extending endless chain or endless belt. The bag magazines are arranged in an articulated manner at the conveying means, preferably at an endless chain.

For another particularly advantageous construction it is suggested that the bag magazine have a base support surface for the bags which is inclined toward the movement direction of the conveying means and further that the bag magazines have a lower stop at an angle relative to the inclined base and that the bag magazines have a stop on at least one side in the longitudinal conveying direction. The inclination of the base support surface can be 15° to 60°, preferably 20° to 45°.

Further, in a preferred construction a bag magazine in the insertion position defines the maximum bag stack height in a pocket-like manner by means of the respective preceding bag magazine so that the bag magazines are partly open in the insertion position but completely open at the top in the removal position. On the whole it is preferable to construct the bag stack conveying arrangement in such a way that the bag magazine is articulated at an endlessly circulating conveyor means, the insertion position and the removal position are arranged at respective ends, and in the removal position of a bag magazine the bag magazine which has just been emptied is moved away in a downward direction. However, the stack pockets can also have a curved base and/or be inclined in a twofold manner, wherein the curved base can be produced by mechanically adjustable supporting means. The bag stacking arrangement is constructed as a bag bucket conveyor with a plurality of bag magazines which are movable in a stepwise manner in the direction of the conveyor belt by means of an endless chain. In a particularly preferred manner the bag stacking arrangement has a bag bucket conveyor with a plurality of inclined bag magazines which are movable in a stepwise manner from an insertion position into a removal position, gripping means for transferring detached bags from a deflecting belt, and a swivel arm with two gripping claw pairs for preparing a bag at the bag filling sleeve.

The roller deflection means deflect the empty bag at an approximately right or slightly obtuse angle and bring it into an upright, slightly inclined position with the closed end of the bag down. The bag is then brought into a vertical filling position in the region of the bag filling sleeve with a simultaneous opening movement and, in addition, is preferably put into a shape adapted to the bag filling sleeve so that the bag holder can close immediately and clamp the bag at the bag filling sleeve without creases.

The novel invention allows mechanical compulsory movements to be executed at very high speed. However, the consequent dividing up of the overall course of movement has the additional very special advantage that more time remains for the first movement, for the problem phases, namely the gripping and detaching of a bag from the bag stack in spite of the much reduced time overall, and this can therefore be carried out more carefully and even more calmly. All movements can be compulsorily controlled. The bag is always grasped at the correct location, the greatest distance covered is in the longitudinal direction of the bag. A transverse movement of the bag is required only during the opening and transferring to the bag filling sleeve. However, the bag is rigidly held and guided at the weaker opening end so that very high speeds can be used without risk.

For a better understanding of the present invention, reference is made to the following description and accompanying drawings while the scope of the invention will be pointed out in the appended claims.

DETAILED DESCRIPTION OF THE INVENTION, PREFERRED EMBODIMENTS AND BEST MODE

Figure 1:
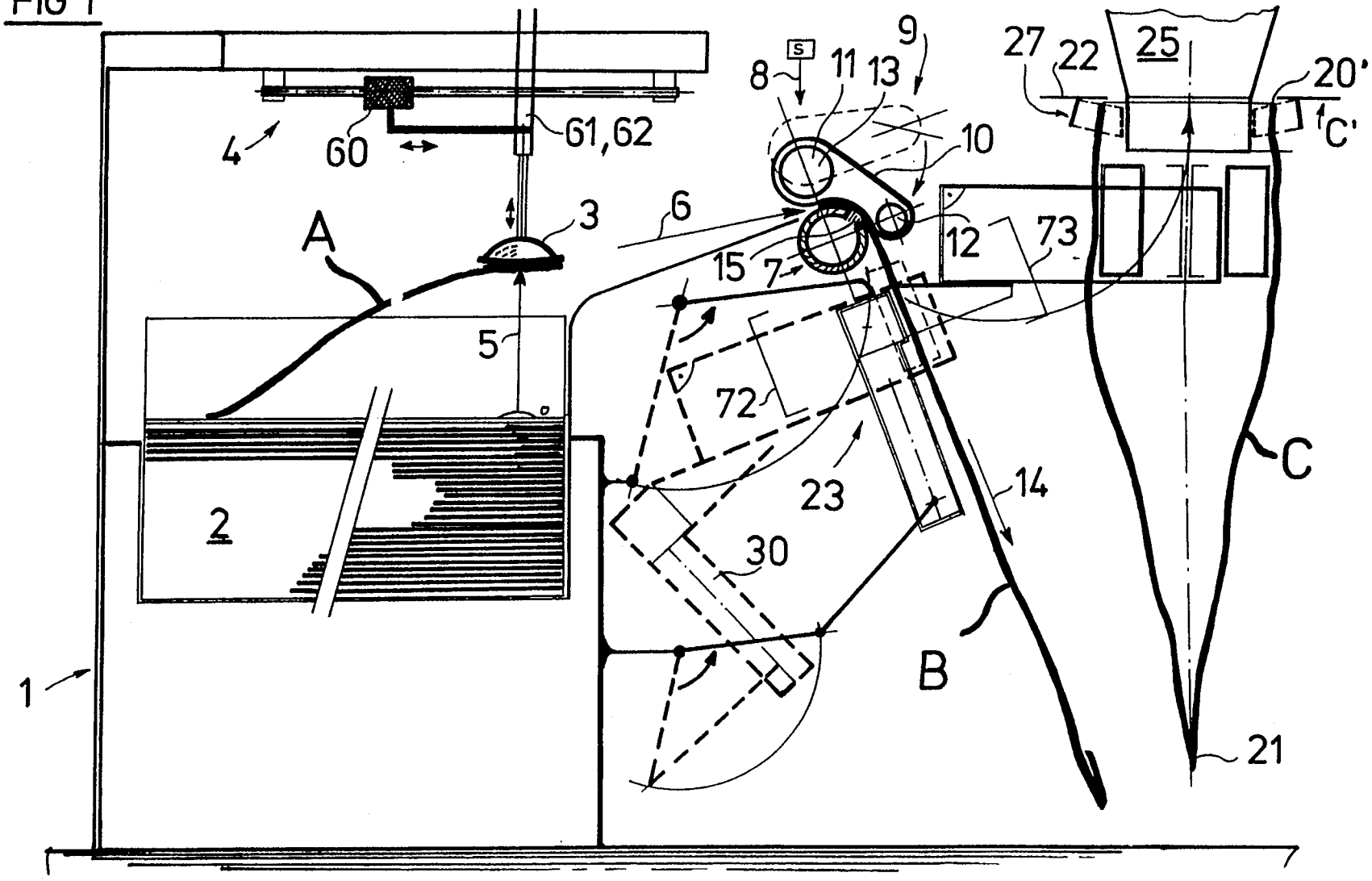
FIG. 1 shows a schematic overview of the course of movements for hanging bags.

Reference is had to FIG. 1 in the following. A bag stack conveyor 1 has a stack 2 of empty bags lying flat one on top of the other. In a first play of movement, a bag A is lifted at its closed end by suction cups 3 of a bag removal device 4, arrow 5, and the bag opening hangs down. Subsequently, the bag A is advanced to roller deflection means 7 in an approximately horizontal movement, arrow 6. Arrow 8 indicates that the course of horizontal movement must be controlled in an exact and advantageous manner by corresponding sensors, e.g. with a stop for the bag position relative to the roller deflection means 7. A plurality of deflecting belts 9, which include a rubber belt 10, a main roller 11 and a tension roller 12, are arranged along the roller deflection means 7. The main roller 11 and a tension roller 12 together form a deflection roller pair 13.

After the bag is guided into the correct starting position relative to the roller deflection means 7, the deflecting belt 9 can be lowered either at the end of the insertion position and/or in a coordinated course of movement. The bag is clamped between the roller deflection means 7 and the deflection belt 9 and the continued feed of the bag A starts immediately, e.g. according to a start signal after the inserting movement or in a transition movement, with the rotary drive of the roller deflection means 7 and/or deflecting belt 9. The vacuum at the suction cups 3 must first be eliminated so that the roller deflection means 7 can freely take over the bags. The bag A is now moved downward around the roller deflection means 7 at an approximately right angle, arrow 14, the end position being controlled again by sensor means, arrow 8, in such a way that the open end of the bag located on top remains at a position of the roller deflection means 7 which is exactly determined beforehand at the end of the movement 14. The roller deflection means 7 has suction openings 15 exactly in this region which can likewise be connected to a controllable vacuum pump. In this way vacuum suction is applied to the bag ply contacting the roller deflection means 7, or the corresponding inner ply, at the end of the movement 14.

Figure 2:
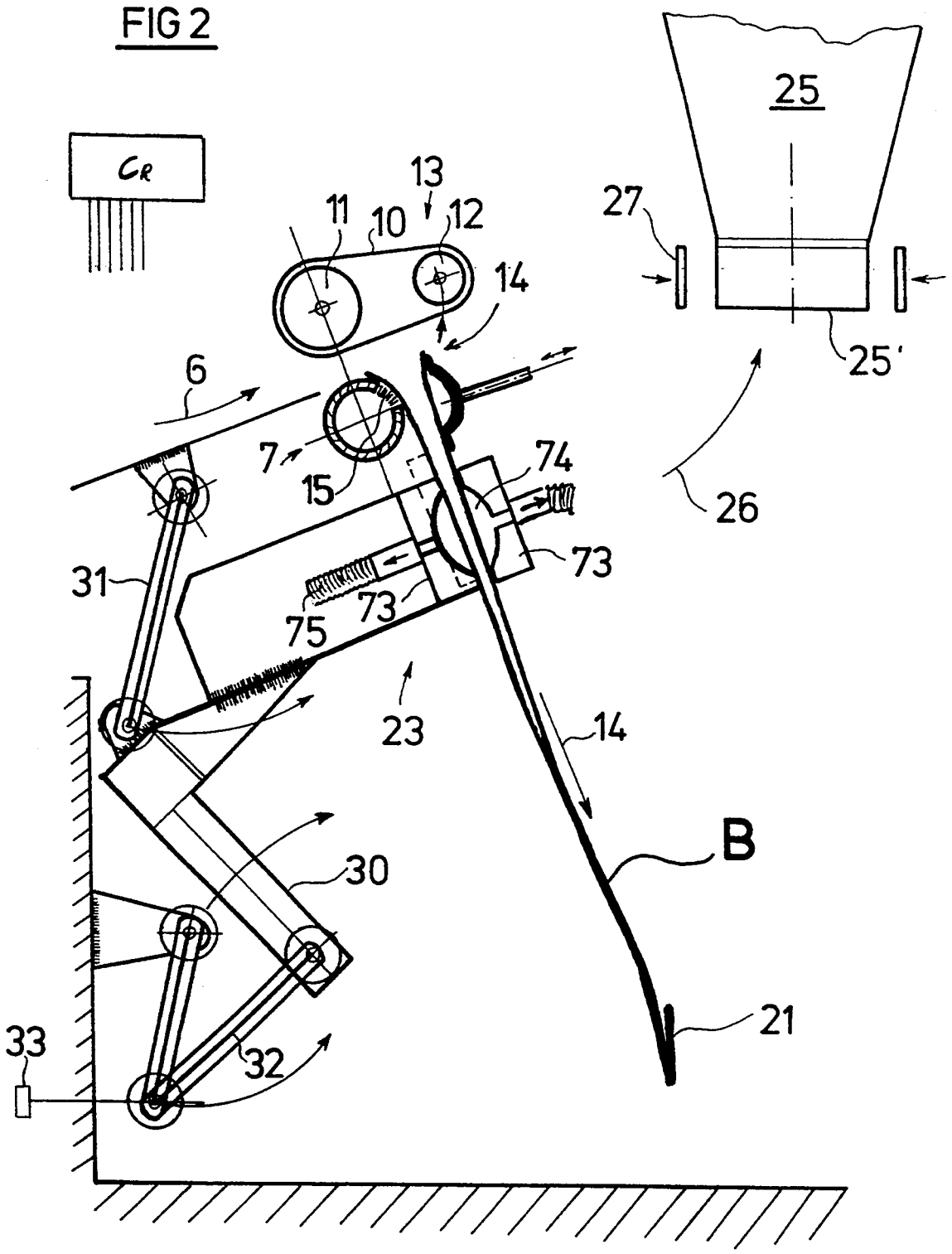
FIG. 2 shows the initial opening of the bag.

On the other hand, the opposite outer paper ply tends to remain in a straight, stretched position (see FIG. 2) which causes the opening of the bag to be initiated. This initiation is additionally prepared by the intensive deflecting process around the roller deflection means 7 together with the deflecting belt 9. The bag is now opened slightly by additional controllable suction cups 3 and corresponding pre-opening means 35 as long as it still adheres to the roller deflection means. The bag B is thus in a very accurate position at the end of the movement 14 with its end 20 already slightly opened (FIG. 2). The lower closed end 21 of the bag hangs down in a slightly upright diagonal position (arrow 14). However, the diagonal position does not need to be very exact, since the gripping claw pair which will be described in the following allows quite a large area of play for this. The bag B is now grasped by a gripping claw device 23, completely opened, and transferred with its upper end 20′ completely opened via a circular path 25 to a bag filling sleeve 25 by means of a swivel arm 30. The fastening of the bag C at the bag filling sleeve 25 is effected via stationary bag clamps 27, so that the gripping claw device 23 can return to the initial position again (FIG. 6*a*).

FIG. 2 shows the position of the bag B at the start of the bag opening in a somewhat enlarged scale. The gripping claw arrangement 23 is securely connected with a swivel arm 30. The swivel arm 30 is supported at the top via a simple arm 31 which is supported at both sides in an articulated manner and is supported at the bottom via an articulated lever 32 in a swivelable manner in such a way that an exact, positively guided course of movement, arrow 26, results via a controllable drive 33.

Figure 3:
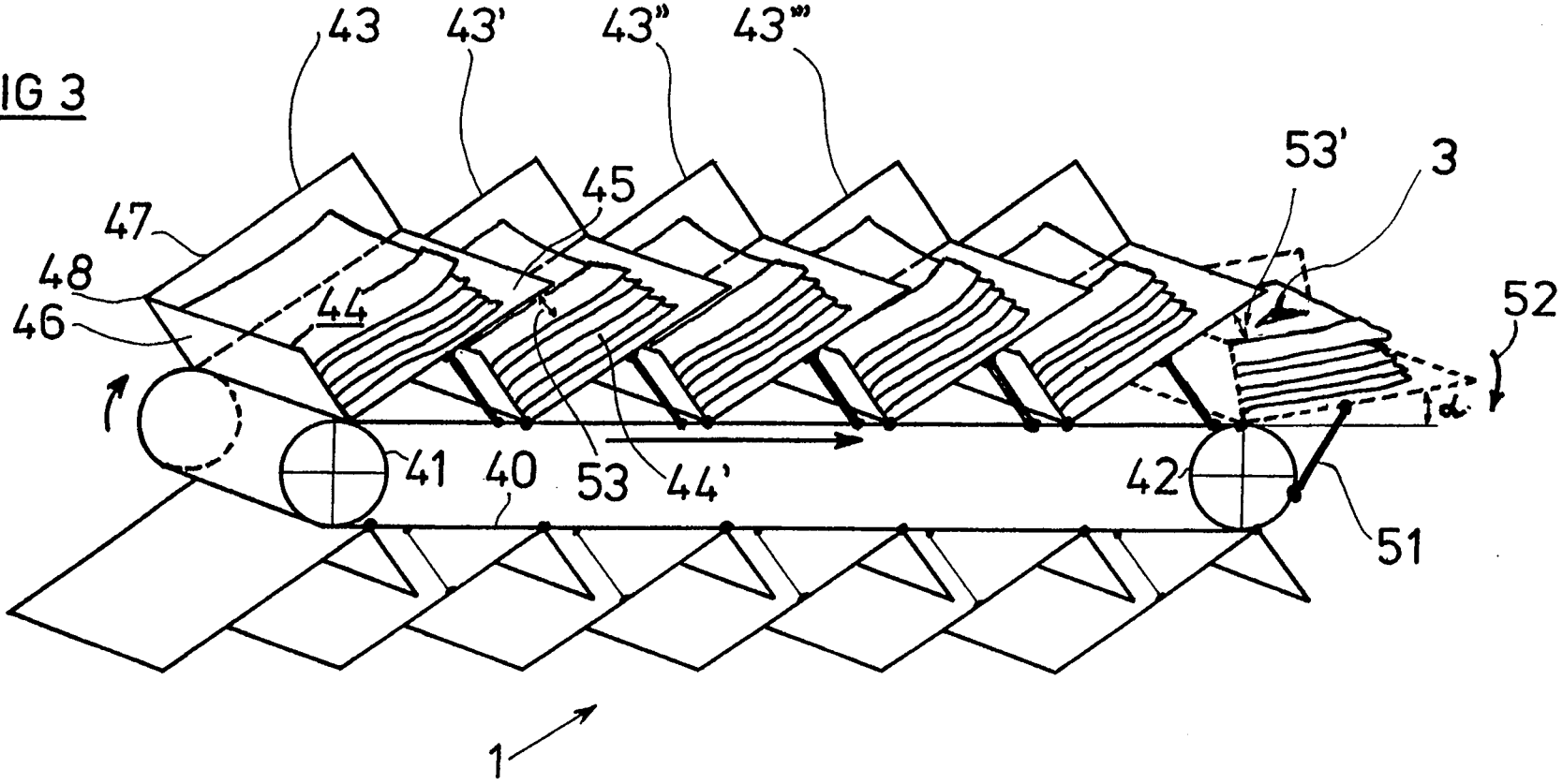
FIG. 3 shows a novel stack pocket conveyor schematically.
Figure 4:
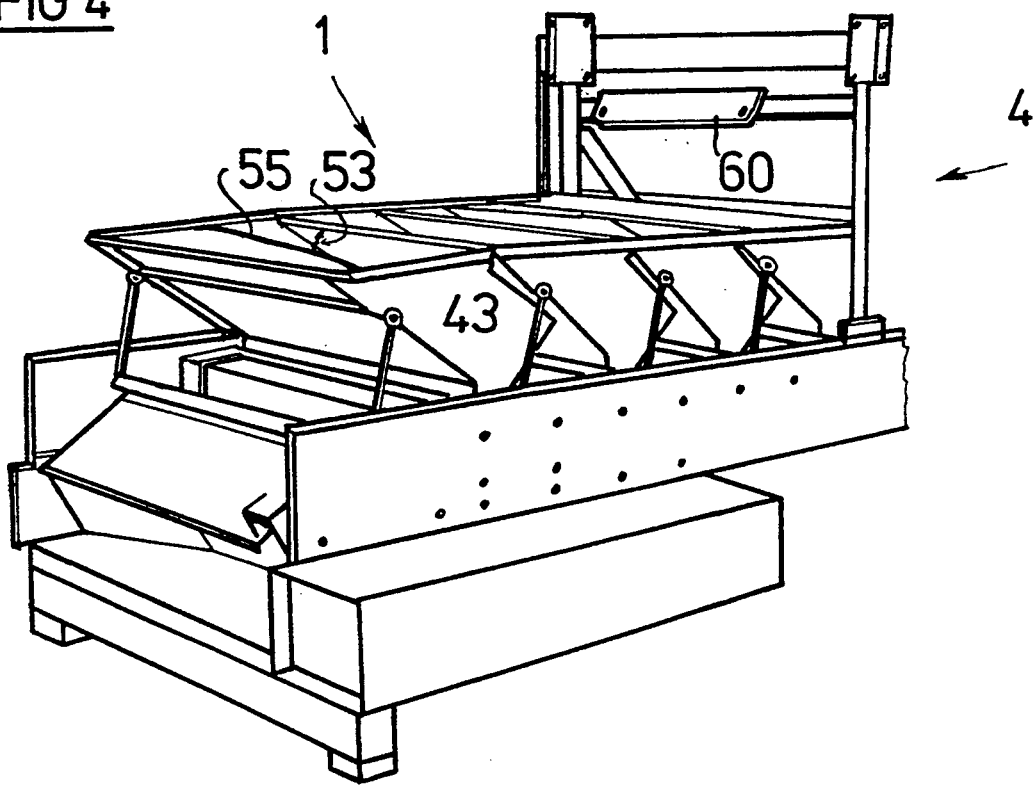
FIG. 4 shows a perspective view of the stack pocket conveyor of FIG. 3.

FIGS. 3 and 4 show a stack pocket conveyor 1. An endless chain 40 which is guided around two chain wheels 41, 42 carries a plurality of individual, bucket-shaped bag magazines 40, 40′, 40″, etc. each of which can receive a stack of bags 44, 44′, etc. Only the bag magazines 40, 40′, etc. located on top are in operation, but not the empty bag magazines 43 located at the bottom. Every bag magazine has a base support surface 45, a lower stop 46, and at least one lateral stop 47 so that the bag can be pushed into a corner 48 without expenditure of energy when inserted. This means that the bag can always be precisely placed in an exactly defined position regardless of its size, length or width and can be removed individually by a bag removal device 4. Every bag magazine is connected in an articulated manner by its closest corner to the endless chain and via a supporting articulated lever 51 so that the inclination $\alpha$ of the bag magazine is adjustable to a certain extent in the removal position by means of a downward movement of the supporting articulated lever 51, according to arrow 52. At the same time the overlap 53 formed previously by the advancing stack pocket is eliminated so that the stack pocket is completely open at the top for removal of the bag, which is indicated by the position in dashed lines.

Figure 5:
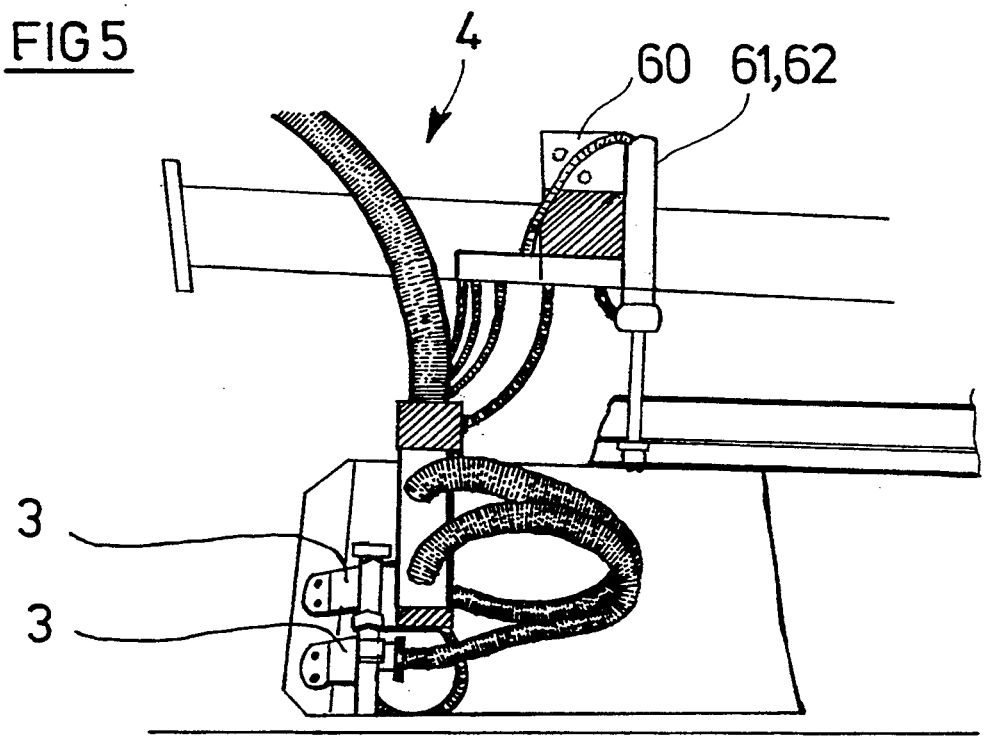
FIG. 5 shows a bag removal and detaching device.

On the left-hand side of FIG. 4, the base support surface 45 is constructed so as to be curved inward, which is indicated by line 55. The bag removal arrangement 4 which has a horizontal carriage 60 and a lifting and lowering device 61 is indicated on the right-hand side of FIG. 4. An angular movement is also carried out simultaneously with the lifting and lowering in order to lift a bag into a horizontal position, see cylinder 62 in FIG. 5. FIG. 5 also shows that two suction cups 30 are used.

Figure 6:
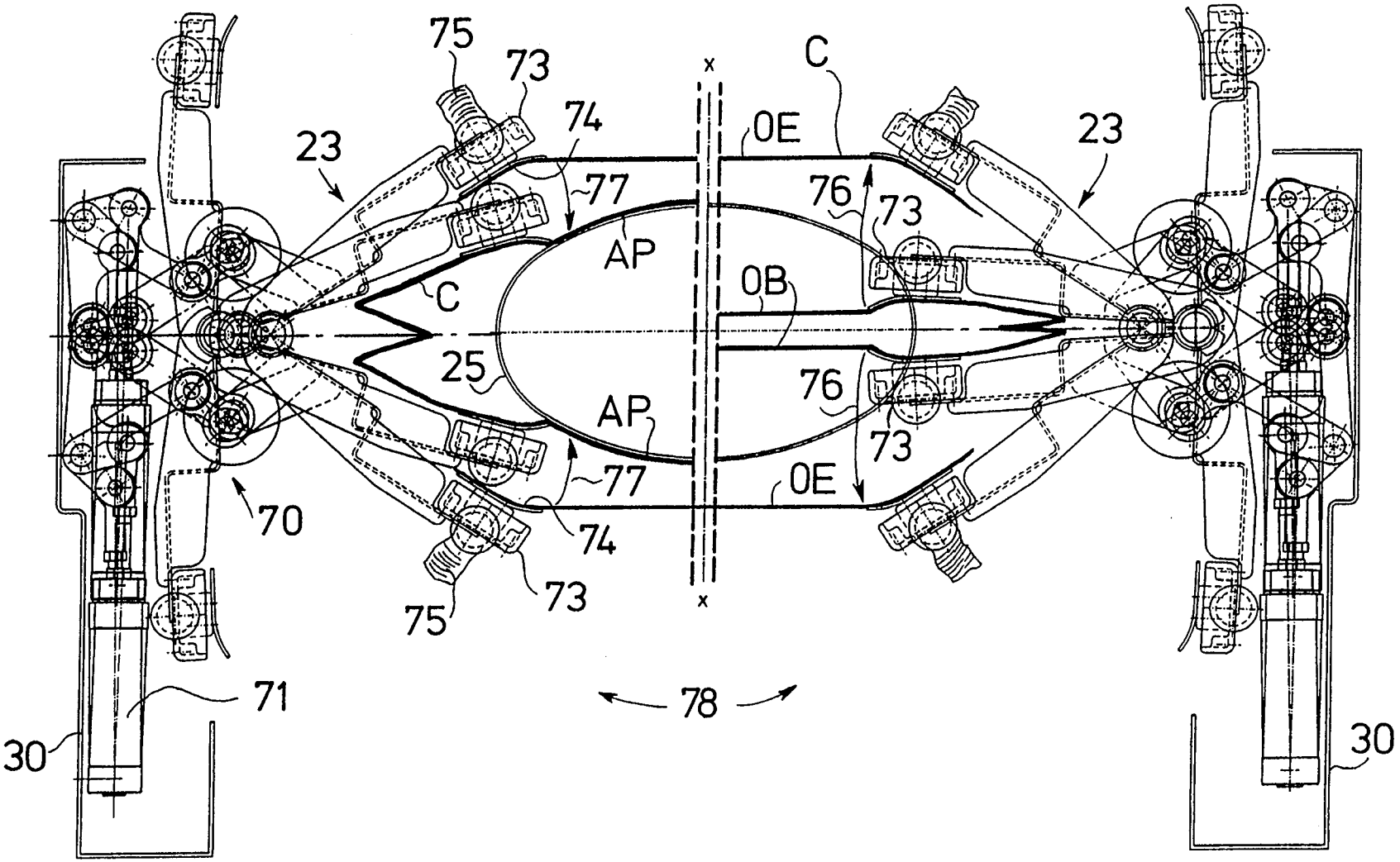
FIG. 6 shows different work positions of gripping claw pairs for opening and hanging the bag, in a schematic manner.

FIG. 6 shows the gripping claw arrangement 23 with two gripping claw pairs 23 and 23′, respectively, which are coordinated via a control unit, not shown, but can carry out movements in opposite directions. Each gripping claw pair 23 has a finger-like function and has a controllable lever system 70 and 70′, respectively, for this purpose. The drive is effected via pneumatic cylinders 71 and 72, respectively. Every gripping claw pair 23 has at least two holding pockets 73 in which suction cups 74 are arranged, the suction cups 74 being connected to a vacuum pump via a line 75.

All functions, that is the movement of the swivel arm 30 articulated at the gripping claw pairs 23, and the holding pockets 73 and 73′, respectively, as well as the cyclical application and elimination of the vacuum, are controlled according to a fixed, but individually adjustable program.

Three basic positions for the bag opening are shown in FIG. 6. The bag transfer in the already slightly opened state and the start of the actual opening, designated by OB, are shown on the right side of the drawing. As indicated by arrows 76, the holding pockets 73 are spread apart until the maximum opening OE for hanging at the bag filling sleeve 25. In the left half of the drawing, the movement designated by arrow 77 shows the smooth placement of the bag material at the bag filling sleeve 25.

Figure 7:
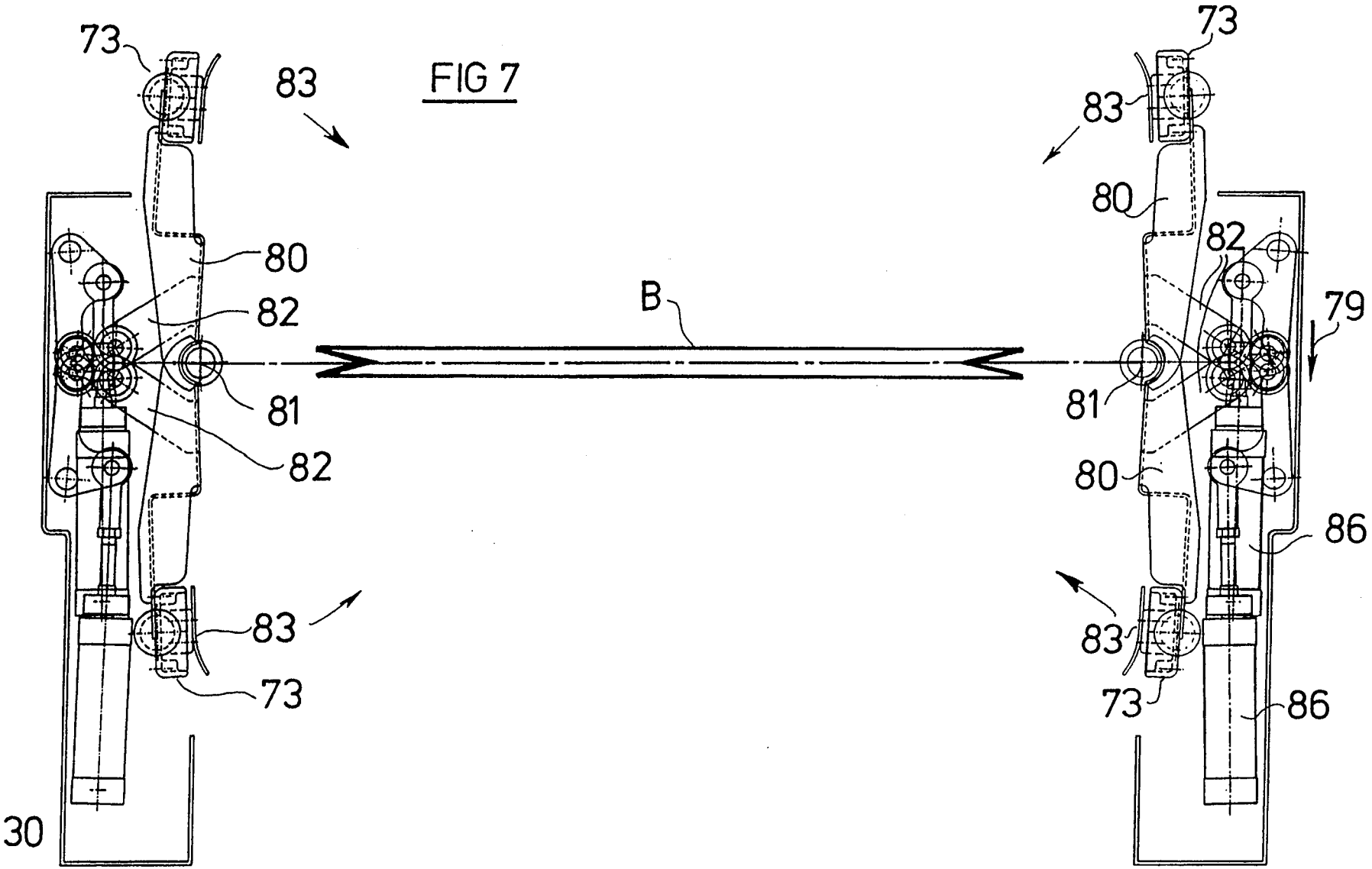
FIG. 7 shows the return and initial position of the gripping claw pair.

In FIG. 7, the bag B has already been slightly opened and is in the ready position for takeover by the automatic opening and hanging means 78. Both pairs of gripping claws 73 are opened to the maximum degree for a displacement movement, arrow 79, into the bag gripping position. The gripping claws 73 are guided in pairs via a holding stirrup 80 in a pivot bearing 81 on the one hand, as well as impact clips 82.

Figure 8:
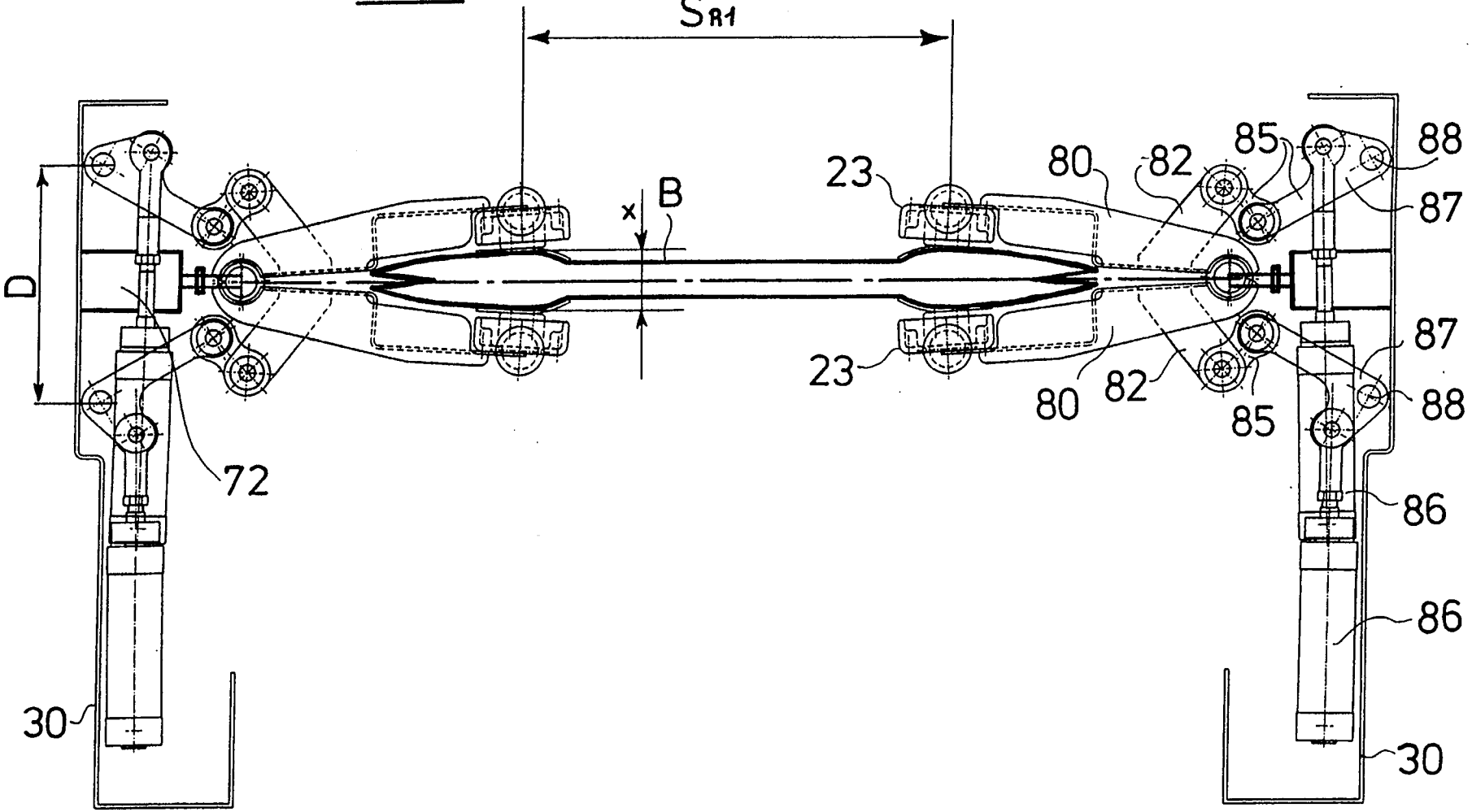
FIG. 8 shows the grasping of the slightly opened bag and the initial opening of the bag.

In FIG. 8 the gripping of the bag shows the gripping claw pairs 23 and already the start of the actual opening of the bag simultaneously. Each of the gripping claws has suction cups 83 at the inside which are connected to a vacuum line 84. It has proven very important particularly with paper bags that the gripping claw pairs come together when gripping the bag only until a minimum distance X is reached so that the vacuum which acts from two sides does not cause mutual disturbance or so that the double plies in multiple-ply paper bags are not ripped apart.

The bag gripping position is adjusted via holding stirrups 80 at both sides and knee joints 85 arranged in a twofold manner, as well as by controlled pneumatic cylinders 86. An articulated lever 87 is fastened at the swivel arm 30 via bearings 88 at a rigidly determined distance D.

Figure 9:
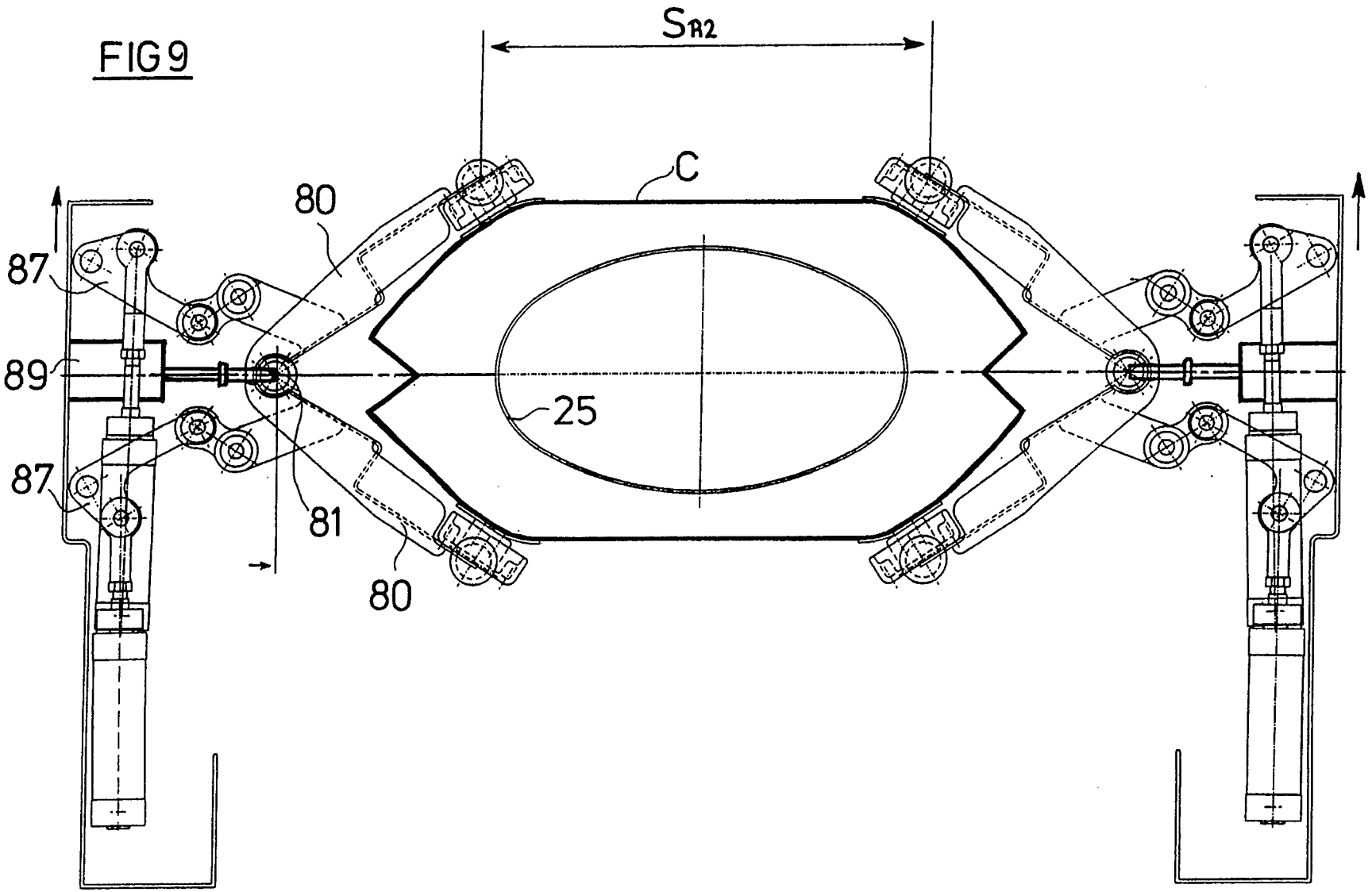
FIG. 9 shows the completely opened position of the gripping claw pairs and the preparation of the bag at the filling sleeve.

The movement from FIG. 8 to FIG. 9 results on the one hand from a substantial rigidity of the articulated lever 87, which now supports the movement of the holding stirrup 80, and an inward displacement of the pivot bearing 81 via an additional controlled pneumatic cylinder 89 on the other hand. By means of this step, the bag material is stretched during the opening movement only just as far as needed from measurement $SR_1$ to measurement $SR_2$ so that no excessive stresses occur.

Figure 10:
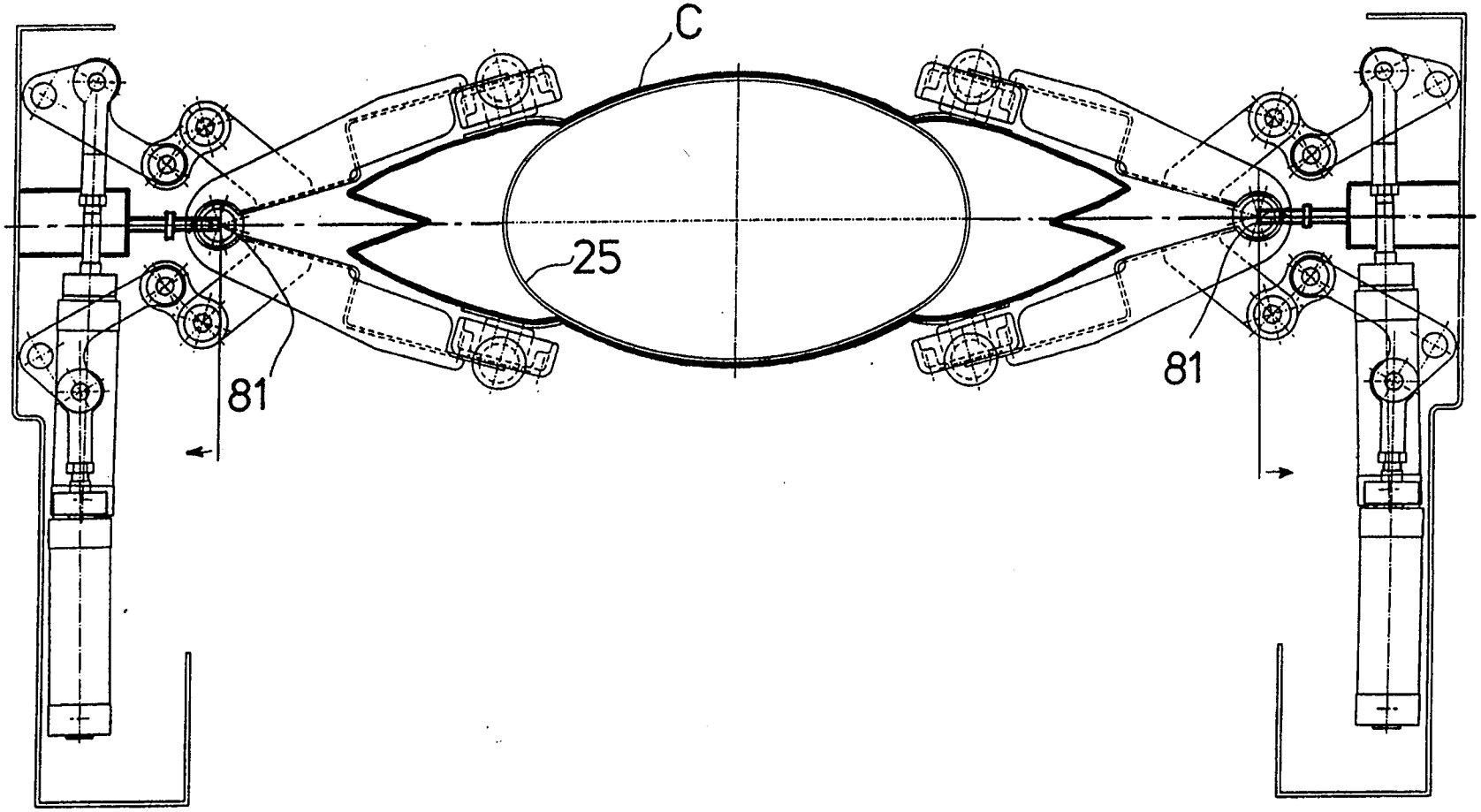
FIG. 10 shows the opening of the bag in the placement position on the filling sleeve.

The conclusion of the bag placement process at the bag filling sleeve 25 is shown in FIG. 10. This movement is achieved by a retracting of the pivot bearing 81 via the pneumatic cylinder 89. It is important in this case that the bag be placed at the bag filling sleeve without creases so that a bag hanging results in a faultless manner for the bag clamp 27. In particular, the bag material is not wrinkled or balled up, which would have a very negative influence on subsequent bag closure. After the bag has been clamped at the bag filling sleeve, the automatic opening and hanging device returns to the position of FIG. 7 again and the next sequence is effected.

While the foregoing description and drawings represent the preferred embodiments of the present invention, it will be obvious to those skilled in the art that various changes and modifications may be made therein without departing from the true spirit and scope of the present invention.

What is claimed is:

1. In a method for the automatic preparation of bags for packing bulk material by means of positive guidance of the bags from a stack of bags having a closed end and an openable end for bag filling, opening of the bag filling opening, and hanging of the open end of the bag at a bag filling sleeve, whereby a plurality of bags are stacked and removed individually from a removable location, swiveled, opened and hung, the improvement comprising the steps of:

grasping the bags at their closed end from the stack, bringing the bags into an upright position along at least an approximately right angle by a deflecting feed unit, and bringing the bags to a bag filling sleeve by a bag opening device.

2. The method according to claim 1, including guiding the bags into an upright position from the bag stack via a deflecting feed unit and opening them slightly in the region of the deflecting feed unit when reaching the upright position.

3. The method according to claim 1 or 2, including opening the bags in at least two steps by separate automatic means.

4. The method according to claim 1, wherein the bag opening is effected by means of gripping claws acting in opposite directions, the gripping claws acting on each bag after it has already been slightly opened.

5. The method according to claim 1, including the step of forming bag stacks which can be mechanically displaced repeatedly, the bags being inserted manually at a displacement path in a separate operation and removed individually by automatic means.

6. In an automatic bag hanging apparatus for bulk materials by automatic preparation of bags for packing of the bulk material by positive guidance of the bags from a bag stack of bags having a closed end and an openable end for bag filling, by opening of the bag filling opening and by hanging of the open end of the bag at a bag filling sleeve, whereby a plurality of bags are stacked and removed individually from a removable location, swiveled, opened and hung, the apparatus including means for removal of individual bags from a bag stack by gripping action, means for opening of the bag filling opening, and means for hanging of the open end of the bag filling sleeve, the improvement comprising:

means for bringing a bag lying flat with its closed end in front around roller deflection means into an upright position; and means for bringing the upright bag to the bag filling sleeve by a swiveling and opening device.

7. Automatic bag hanging apparatus according to claim 6, wherein a plurality of deflecting belts are arranged in a region along the roller deflection means, which deflecting belts are adaptable in shape along one portion so as to conform to said roller deflection means, each deflecting belt being movable toward and away from the roller deflection means by the belt for a looping movement with respect to the roller deflection means.

8. Automatic bag hanging apparatus according to claims 6 or 7, wherein means are included for transferring a bag lifted from the bag stack into an inclined position from the horizontal line by the roller deflection means with the closed end of the bag in front.

9. Automatic bag hanging apparatus according to claim 6, wherein the roller deflection means are constructed as a rotationally movable hollow cylinder and is adapted to be connected to a vacuum pump, and a partial area of a wall of the cylinder has a suction opening for gripping the bag and an opening device to which movable pre-opening cups are associated acts in an opposite direction relative to the suction openings.

10. Automatic bag hanging apparatus according to claim 9, wherein said roller deflection means functions so that an inner bag ply remains adhering to the partial region of the cylinder wall by suction openings in the region of the bag opening after conclusion of the deflecting movement, while an outer bag ply is adapted to be opened by suction cups.

11. In an automatic bag hanging apparatus for bulk materials by automatic preparation of bags for packing of the bulk material by positive guidance of the bags from a bag stack of bags having a closed end and an openable end for bag filling, by opening of the bag filling opening and by hanging of the open end of the bag at a bag filling sleeve, whereby a plurality of bags are stacked and removed individually from a removable location, swiveled, opened and hung, the apparatus having the improvement comprising:

means for individual bag preparation; and a gripping claw pair which is arranged at a swivel arm which is compulsorily driven in opposite directions for transferring an opened bag from the bag preparation to the bag filling sleeve.

12. Automatic bag hanging apparatus according to claim 11, wherein the gripping claw pair executes an opening and closing movement via a lever articulation and pneumatic drive means analogous to the thumb and index finger of a human hand.

13. Automatic bag hanging apparatus according to claim 11, wherein said swivel arm is capable of executing a circular movement directed from the bottom to the top for hanging a bag via a double-lever system, wherein the gripping claws and the bag hanging apparatus are controllable independently and have means for coordinating the two sequences of movements.

14. Automatic bag hanging apparatus according to claim 11, wherein the bag opening claws are capable of being brought into a totally spread apart return or initial position, into a closed position, and into a controllable maximum bag opening position via a lever articulation which is movable in a compulsory manner by hydraulic means.

15. Automatic bag hanging apparatus according to claim 11, wherein the bag opening claws are capable of being brought into a totally spread apart return or initial position, into a closed position, and into a controllable maximum bag opening position via a lever articulation which is movable in a compulsory manner by pneumatic means.

16. Automatic bag hanging apparatus according to claim 12, wherein means are included for bringing the bag opening claws from the bag opening position into a controllable bag filling sleeve form position which have suction cups.

17. In automatic bag hanging apparatus for bulk materials by automatic preparation of bags for packing of the bulk material by positive guidance of the bags from a bag stack of bags having a closed end and an openable end for bag filling, by opening of the bag filling opening and by hanging of the open end of the bag at a bag filling sleeve, whereby a plurality of bags are stacked and removed individually from a removable location, swiveled, opened and hung, the apparatus having a bag stack conveying device having a plurality of individual bucket-shaped bag magazines which are movable from an insertion position into a removable position via controllable conveying means, each bag magazine having a base support surface for the bags which is inclined toward the movement direction of the conveying means, the improvement comprising that the bag magazines have a stop in the longitudinal conveying direction at least on one side, wherein the inclination of the base supporting surface is limited to the range of 15° to 45°.

18. Automatic bag hanging apparatus according to claim 17, wherein the stack pockets have a curved base.

19. Automatic bag hanging apparatus according to claim 17, wherein the stack pockets have a two-fold inclination.

20. Automatic bag hanging apparatus according to claim 18, wherein the curved base can be produced by mechanically adjustable supporting means.

* * * * *